United States Patent [19]

Kumazawa et al.

[11] 4,294,018

[45] Oct. 13, 1981

[54] MATERIAL FEED PIPE FOR USE IN BELT-SYSTEM CONTINUOUS VACUUM DRIER

[75] Inventors: Eitaro Kumazawa, Sayama; Yukihiro Saiki, Oaza-Hidaka; Yozo Ishioka, Higashi-Kurume, all of Japan

[73] Assignee: Snow Brand Milk Products Co., Ltd., Sapporo, Japan

[21] Appl. No.: 138,812

[22] Filed: Apr. 9, 1980

[30] Foreign Application Priority Data

Jul. 25, 1979 [JP] Japan ..... 54-94731

[51] Int. Cl.[3] ..... F26B 15/10

[52] U.S. Cl. ..... 34/56; 34/92; 222/564; 239/553.3

[58] Field of Search ..... 34/92, 56, 25, 236; 239/553, 553.3; 222/412, 415, 564

[56] References Cited

U.S. PATENT DOCUMENTS 1,126,939 2/1915 Batton ..... 239/553.3

4,229,886 10/1980 Durant ..... 34/92

*Primary Examiner*—Larry I. Schwartz

*Attorney, Agent, or Firm*—Blanchard, Flynn, Thiel, Boutell & Tanis

[57] ABSTRACT

A material feed pipe for use in a belt-system continuous vacuum drier and oriented above a belt moving within a vacuum drying chamber. The feed pipe includes an inner tube having its one end provided with an inlet for material and the other end being closed. An outer tube has its two ends closed and encircling said inner tube with a radial space therebetween. A plurality of nozzle openings are provided in an upper part of the inner tube at a fixed pitch along the axial length thereof. The nozzle openings are so devised as to have a larger diameter in regular succession from the inlet end to the opposite end of the inner tube; and a plurality of further nozzle openings are provided in the lower part of the outer tube at a fixed pitch along the axial length thereof and have a fixed diameter.

2 Claims, 5 Drawing Figures

MATERIAL FEED PIPE FOR USE IN BELT-SYSTEM CONTINUOUS VACUUM DRIER

FIELD OF THE INVENTION

The present invention relates to an improvement on a material feed pipe for use on the occasion of feeding highly viscous, heat-sensitive materials onto a belt moving continuously within a vacuum drying chamber to effect drying.

And, as for said slurry-state material, when the viscosity is in the range of from 5 to 100 poises, the present invention can be applied particularly effectively.

BACKGROUND OF THE INVENTION

At the time of drying such a material as stated above, in order to avoid thermal denaturation thereof, lowering of the evaporating temperature of the moisture contained in the material is contemplated and the vacuum drying method is generally employed for this purpose.

This method is usually performed by moving a belt in a vacuum drying chamber and distributing a material on this belt.

In this case, as a point on which special stress should be laid, there is cited the state of distribution of the material on the belt. In other words, the material should be continuously supplied onto the belt in regular quantities and in a uniform thickness. Should the material fail to be supplied in this state, balance between the quantity of material supplied and the quantity of heat supplied will be lost, resulting in partial occurrence of scorched powder or crude powder due to superheating or insufficient heating to thereby bring about an unsatisfactory product lacking in uniformity of quality.

Accordingly, in order to continuously obtain a product of good quality by easy operation, provision of a feed device capable of distributing a material onto a belt in a quantity opposite to a fixed temperature for heating as well as in a uniform thickness is hoped for.

To cite an instance of this kind of feed device, such a feed pipe as denoted by reference numeral 1 in FIG. 1 has hitherto been used. This feed pipe 1 is of a construction that a plurality of nozzles 3 with a fixed diameter are provided in the lower part of a cylinder 2 at a regular pitch l along the axial direction thereof, and a material fed through an inlet for material 4 disposed on one end of the cylinder is to be distributed onto a belt through said nozzles 3.

However, this feed pipe 1 has been defective in that the internal resistance of the parts extending from the inlet pipe for material 4 to the opposite end varies and accordingly the linear velocity v of the material in a nozzle close to the inlet pipe 4 comes to be the highest and decreases with the advance of the material toward the inner part while the linear velocity v' of the material in a nozzle at the opposite end comes to be the lowest, thereby causing the quantity of the material distributed onto the belt to be uneven.

SUMMARY OF THE INVENTION

One object of the present invention is to eliminate the foregoing defects of the conventional material feed pipes and to provide a material feed pipe which renders it possible to obtain a regular quantity of products having a fixed moisture content with respect to various materials.

Accordingly, the present invention relates to a material feed pipe to be disposed above a belt moving within a vacuum drying chamber, which comprises: an inner tube having at one end a material inlet and being closed at the other end thereof; an outer tube having its two ends closed an encircling said inner tube with a radial spacing therebetween; a plurality of nozzles disposed in the upper part of said inner tube at a fixed pitch along the axial direction thereof, said nozzles being so devised as to have a larger diameter in regular succession from the inlet end to the opposite end of the inner tube; and a pluality of nozzles disposed in the lower part of said outer tube at a fixed pitch along the axial direction thereof.

Another object of the present invention is to provide a material feed pipe which is suitable for use in feeding sweetened condensed milk as material and renders it possible to distribute said milk uniformly onto a belt moving with a vacuum drying chamber.

Accordingly, the present invention relates to a material feed pipe which is characterized in that inasmuch as said sweetened condensed milk is a fluid demonstrating the property of a Newtonian flow as Hagen-Poisenille's law holds, when the radius of the nozzle nth from the end opposite to the inlet end of said inner tube is expressed by $r_n$, the radius of the nozzle n+1 from the same is expressed by $r_{n+1}$, the pitch between two adjoining nozzles is expressed by L, the radius of the inside of the inner tube is expressed by R and the thickness of the circumferential wall of the inner tube is expressed by t, each nozzle of the inner tube is formed to a size determined by the following equation:

$$\frac{1}{(r_{n+l})^4} - \frac{1}{(r_n)^4} = \frac{nL}{R^4 \cdot t}$$

DETAILED DESCRIPTION OF THE INVENTION

Figure 1:
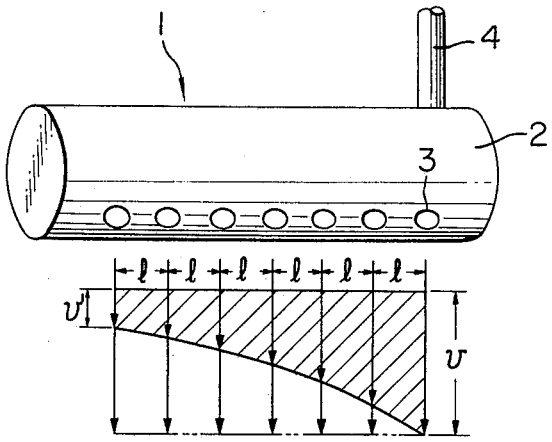
FIG. 1 PRIOR ART
FIG. 1 is a perspective view of a material feed pipe in the prior art, illustrating thereunder the velocity distribution of the material flowing out of nozzles.
Figure 2:
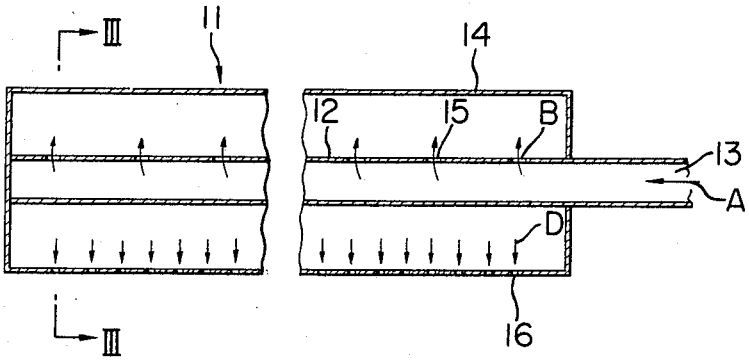
FIG. 2 is a schematic representation of a longitudinal sectional view, as taken along the center axis and partly broken away, of an instance of the material feed pipe for use in a belt-system continuous vacuum drier according to the present invention.

In FIGS. 1 and 2 there is schematically shown a material feed pipe, as denoted by reference number 11, for use in a belt-system vacuum drier according to the present invention. This material feed pipe 11 consists of an inner tube 12 having its one end provided with an inlet for material and the other end closed and an outer tube 14 having its two ends closed and covering said inner tube 12 with a radial spacing therebetween. The thus constructed material feed pipe 11 is disposed above a belt not shown herein which moves continuously within a vacuum drying chamber and preferably along a direction practically normal to the direction of movement of said belt as well as practically horizontally.

The inner tube 12 is preferably of cylindrical shape, and the upper part thereof is provided with a plurality of nozzles 15 formed along the axial direction and preferably in a row. The shape of each nozzle 15 is desirably circular, but any shape other than circular shape is also in the scope of the present invention. The pitch of these nozzle 15 is regular along the axial direction of the inner tube 12, and individual nozzles 15 are so devised as to have a larger diameter in regular succession from the inlet side of the opposite side of the inner tube 12.

The outer tube 14 is also preferably of cylindrical shape, and is disposed coaxially relative to the inner tube 12. The lower part of this outer tube 14 is provided with a plurality of nozzles 16 formed along the axial direction and practically in a row. The shape of each nozzle 16 can be optionally determined, but is preferably circular. The pitch of these nozzles 16 is regular along the axial direction of the outer tube 14 like in the case of the nozzles 15. However, unlike the nozzles 15, the diameter of all the nozzles 16 is unified.

Figure 3:
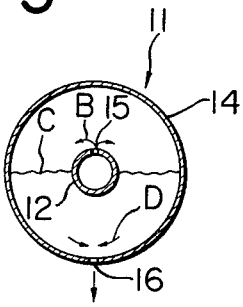
FIG. 3 is a schematic representation of a cross sectional view taken along the line III—III in FIG. 2.

Accordingly, it will be understood that a viscous material introduced through the inlet 13 as indicated by the arrow A in FIG. 2 overflows the inner tube 12 through the nozzles 15 as indicated by the arrows B in FIGS. 2 and 3, gathers temporarily within the outer tube 14 as expressed by C in FIG. 3, and then falls on the belt through the nozzles 16 as indicated by the arrows D in FIGS. 2 and 3. A matter to be given heed to on this occasion is that the relation between the total area of openings of the nozzles 15 and the total area of openings of the nozzles 16 should be previously set on the one hand so as to permit temporary gathering of the material within the outer tube 14 in order to avoid the occurrence of a short circuit between the interior and the exterior of the outer tube 14 through the nozzles 16, and on the other hand so as to prevent the thus gathered material from completely burying the inner tube 12 in order to hold the surface of fluid C at a level lower than the nozzles 15. It will be understood that by so doing the material within the inner tube 12 can be substantially free from the influence of the negative pressure from the vacuum chamber.

Next, with reference to FIGS. 4 and 5, hereunder will be explained the way of determining the diameter of the respective nozzles 15 of the inner tube 12 which are supposed to have different diameters in the case where the material to be dealt with is sweetened condensed milk.

As is well-known to those skilled in this field of art, sweetened condensed milk is a fluid demonstrating the property of a Newtonian flow and Hagen-Poisenille's law holds. As is well-known, this law states that when a fluid demonstrating the foregoing property flows through a cylinder, the interrelation of the quantity of flow Q[cm$^3$/sec], the fixed radius of cylinder R[cm], the length of cylinder L[cm] and the pressure loss $\Delta P$[g/cm$^2$] can be expressed by the following equation:

$$Q = \frac{\pi R^4 \cdot \Delta P \cdot gc}{8\mu L} \tag{1}$$

In this context, $\mu$ represents the viscosity of fluid [poise], and gc represents the acceleration of gravity [cm/sec$^2$].

Figure 4:
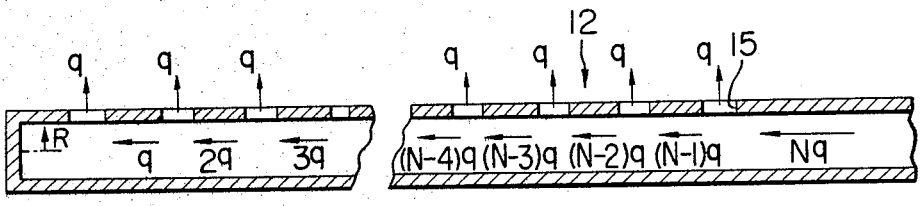
FIG. 4 is a schematic representation of the inner tube, as enlarged and partly broken away, constituting a part of the material feed pipe according to the present invention, wherein the quantity of the material flowing through the inside of the inner tube as well as each nozzle is entered.

In FIG. 4, there is diagrammatically shown the distribution of the quantity of flow in the case where sweetened condensed milk flows through a cylindrical inner tube 12. As will be understood from this diagram, when the number of the nozzles 15 provided for the inner tube 12 is expressed by N, and sweetened condensed milk is permitted to flow through each nozzle 15 by an equivalent of q]cm$^3$/sec], the quantity of sweetened condensed milk flowing through each portion of the inside of the inner tube 12 comes to be as illustrated and, as a result, the gross quantity of flow Q[cm$^3$/sec] comes to be equal to Nq[cm$^3$/sec].

Figure 5:
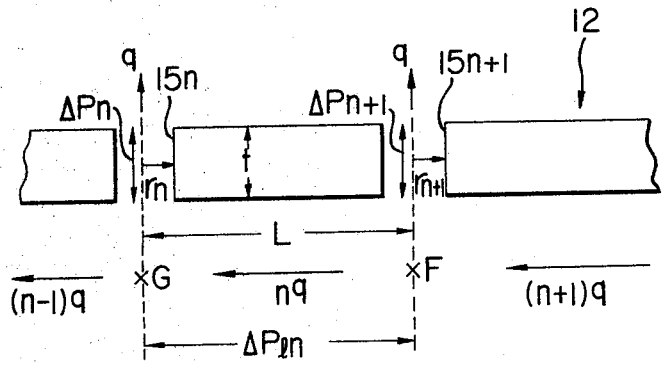
FIG. 5 is a schematic representation, on an enlarged scale, of a part of the inner tube shown in FIG. 4, wherein various symbols for the purpose of explaining the determination of the size of each nozzle of the inner tube are entered.

FIG. 5 illustrates a portion, on a further enlarged scale, of the diagram shown in FIG. 4. As shown in this drawing, when the pressure loss at the nozzle 15*n*, nth from the end opposite to the inlet end of the inner tube 12, is expressed by $\Delta$Pn, the pressure loss at the nozzle $\mathbf{15}_{n+1}$ n+1th from the same is expressed by $\Delta P_n+1$, and the fluid pressure loss within the inner tube 12 between these two nozzles 15*n* and $\mathbf{15}_{n+1}$ (to wit, between F and G) is expressed by $\Delta P_{ln}$, the interrelation of these factors can be expressed by the following equation:

$$\Delta P_{n+1} = \Delta P_n + \Delta P_{ln} \tag{2}$$

In this context, when the thickness of the circumferential wall is expressed by t[cm] and the radius of the nozzle $\mathbf{15}_n$ by $r_n$[cm], $\Delta P_n$ can be expressed as follows by reducing the foregoing equation (1):

$$\Delta P_n = \frac{8\mu tq}{\pi (r_n)^4 \cdot gc} \tag{3}$$

Also, in the same way, $\Delta P_{n+1}$ can be expressed by the following equation when the radius of the nozzle $\mathbf{15}_{n+1}$ is expressed by $r_{n+1}$[cm].

Further, when the radius of the inner tube 12 in the clear is expressed by R[cm] as shown in FIG. 4 and the pitch length between the nozzle $\mathbf{15}_n$ and the nozzle $\mathbf{15}_{n+1}$ by L[cm] as shown in FIG. 5, $\Delta P_{ln}$ can be expressed as follows by reducing the equation (1):

$$\Delta P_{ln} = \frac{8\mu L \cdot nq}{\pi R^4 \cdot gc} \tag{5}$$

By substituting the foregoing equations (3) through (5) in the equation (2), $$\frac{8\mu q}{\pi gc} \cdot \frac{t}{(r_{n+1})^4} = \frac{8\mu q}{\pi gc} \cdot \frac{t}{(r_n)^4} + \frac{8\mu q}{\pi gc} \cdot \frac{nL}{R},$$

and consequently there is obtained an equation $$\frac{1}{(r_{n+1})^4} - \frac{1}{(r_n)^4} = \frac{nL}{R^4 \cdot t} \tag{6}$$

As will be understood from the foregoing descriptions, when each value of R, t and L is determined and the initial value $r_1$ is also determined, each value of $r_2$, $r_3, \ldots r_n, r_{n+1} \ldots$ can be obtained from the equation (6), and consequently the size of every nozzles of the inner tube 12 is settled.

Next, the mode of working of the aforedescribed material feed pipe 11 will be elucidated in the following.

A material such as sweetened condensed milk is inroduced into the inner tube 12 through the inlet 13, overflows through the nozzles 15 to run down along the outer surface of the inner tube 12, is temporarily in the outer tube 14, and thereafter falls down onto a moving belt within a vacuum drying chamber not shown herein through the nozzles 16. In this context, it is to be noted that the size of each nozzle 15 is set beforehand so as to let the sweetened condensed milk flow out through each nozzle 15 by equal quantities if the sweetened condensed milk is to overflow the nozzles 15 into the air, and the interrelation between the total area of openings of the nozzles 15 and the total area of openings of the nozzles 16 is set beforehand so as to permit the outer tube 14 to function as a storing tank for the sweetened condensed milk while holding the fluid surface C at a level lower than the nozzle 15.

Consequently, the sweetened condensed milk within the inner tube 12 comes to be substantially free from the influence of the negative pressure from the vacuum chamber and, accordingly, the sweetened condensed milk flows out through each nozzle 15 by substantially equal quantities as intended by selecting the size of the nozzles 15.

Granting that there remains a slight inequality in the quantity of flow coming out of each nozzle, it will be understood that, because of the presence of the fluid gathered in the outer tube 14, this inequality is not transmitted to the quantity of flow coming out of each nozzle 16 and has no influence thereon. Accordingly, the sweetened condensed milk is let out through each nozzle 16 very uniformly and distributed onto the belt uniformly all over the effective width thereof and in a fixed thickness along the direction of movement of the belt.

The aforedescribed mode of working of the material feed pipe 11 is displayed not only in respect of sweetened condensed milk but also in respect of other various material of similar properties.

Although particular preferred embodiments of the invention have been disclosed in detail for illustrative purpose, it will be recognized that variations or modifications of the above disclosed apparatuses, including the arrangement of parts, lie within the scope of the present invention.

What is claimed is:

1. A material feed pipe for use in a belt-system continuous vacuum drier and oriented above a belt movably mounted within a vacuum drying chamber, comprising: an inner tube member having one end thereof provided with an inlet for material and the other end closed; an outer tube member coaxial with said inner tube and having its two ends closed and encircling said inner tube member and being radially spaced therefrom; a plurality of first nozzle openings provided in an upper part of said inner tube member and oriented at a fixed pitch along the axial length thereof, said first nozzle openings being so devised as to have a larger diameter in regular succession from the inlet end to the opposite end of said inner tube member; and a plurality of second nozzle openings provided in a lower part of said outer tube member and at a fixed pitch along the axial length thereof and having a fixed diameter.

2. A material feed pipe for use in a belt-system vacuum drier according to claim 1, wherein each nozzle of said inner tube member is formed in a size to be determined by an equation $$\frac{1}{(r_{n+1})^4} - \frac{1}{(r_n)^4} = \frac{nL}{R^4 \cdot t}$$

when the radius of the nozzle nth from the end opposite to the inlet of the inner tube member is expressed by $r_n$, the radius of the nozzle n+1th from the same is expressed by $r_{n+1}$, the pitch between two adjoining nozzles is expressed by L, the inner radius of the inner tube member is expressed by R and the thickness of the circumferential wall thereof is expressed by t.

* * * * *